US010655456B2

(12) United States Patent
Espe et al.

(10) Patent No.: US 10,655,456 B2
(45) Date of Patent: May 19, 2020

(54) APPARATUS FOR MONITORING AT LEAST A PORTION OF A WELLBORE

(71) Applicant: Wellguard AS, Tyssedal (NO)

(72) Inventors: Eirik Espe, Tyssedal (NO); Rune Flo, Trondheim (NO); Kjell Ragnar Vågenes, Flatåsen (NO); Frederik Vilhelmsen, Trondheim (NO); Tore Eide, Trondheim (NO)

(73) Assignee: Wellguard AS, Tyssedal (NO)

( * ) Notice: Subject to any disclaimer, the term of this patent is extended or adjusted under 35 U.S.C. 154(b) by 135 days.

(21) Appl. No.: 15/580,982

(22) PCT Filed: Apr. 14, 2016

(86) PCT No.: PCT/NO2016/050069
§ 371 (c)(1),
(2) Date: Dec. 8, 2017

(87) PCT Pub. No.: WO2016/200266
PCT Pub. Date: Dec. 15, 2016

(65) Prior Publication Data

US 2018/0179886 A1 Jun. 28, 2018

(30) Foreign Application Priority Data

Jun. 9, 2015 (NO) ..... 20150748

(51) Int. Cl.
*E21B 33/13* (2006.01)
*E21B 47/10* (2012.01)
(Continued)

(52) U.S. Cl.
CPC ..... *E21B 47/10* (2013.01); *E21B 33/1208* (2013.01); *E21B 33/129* (2013.01);
(Continued)

(58) Field of Classification Search
CPC ..... E21B 47/10; E21B 47/102; E21B 33/13
See application file for complete search history.

(56) References Cited

U.S. PATENT DOCUMENTS 6,098,020 A * 8/2000 den Boer ..... E21B 47/102 702/12
6,478,086 B1 * 11/2002 Hansen ..... E21B 33/02 166/250.17
(Continued)

FOREIGN PATENT DOCUMENTS

NO 319230 B1 7/2005
WO 2006091640 A2 8/2006
(Continued)

OTHER PUBLICATIONS

PCT International Search Report and Written Opinion dated Oct. 18, 2016, issued in corresponding application No. PCT/NO2016/050069 filed on Apr. 14, 2016, 18 pgs.

*Primary Examiner* — Kenneth L Thompson
(74) *Attorney, Agent, or Firm* — Chamberlain Hrdlicka

(57) ABSTRACT

There is described an apparatus for monitoring at least a portion of a wellbore, the apparatus comprising a body including at least an anchoring means for releasably positioning the apparatus with respect to a tubular in the wellbore. The apparatus comprises detecting means for detecting at least one parameter of a substance in the portion, and in that the apparatus comprises transceiver means configured to at least transmit data related to the parameter.

14 Claims, 16 Drawing Sheets

(51) Int. Cl.

| | |
|---|---|
| ***E21B 33/12*** | (2006.01) |
| ***E21B 47/16*** | (2006.01) |
| ***E21B 33/129*** | (2006.01) |
| ***E21B 47/06*** | (2012.01) |
| ***E21B 47/12*** | (2012.01) |
| ***E21B 49/08*** | (2006.01) |

(52) U.S. Cl.

CPC ..... *E21B 47/06* (2013.01); *E21B 47/065* (2013.01); *E21B 47/1005* (2013.01); *E21B 47/1015* (2013.01); *E21B 47/122* (2013.01); *E21B 47/16* (2013.01); *E21B 49/08* (2013.01)

(56) References Cited

U.S. PATENT DOCUMENTS

| | | | | |
|---|---|---|---|---|
| 8,336,620 | B2 * | 12/2012 | Williams | E21B 33/10 166/250.01 |
| 9,759,037 | B2 * | 9/2017 | Shampine | E21B 33/134 |
| 9,797,218 | B2 * | 10/2017 | Duphorne | E21B 33/13 |
| 9,822,632 | B2 * | 11/2017 | Kjorholt | E21B 33/13 |
| 10,100,634 | B2 * | 10/2018 | Ganguly | E21B 47/122 |
| 2002/0170717 | A1 | 11/2002 | Venning et al. | |
| 2004/0246141 | A1 | 12/2004 | Tubel et al. | |
| 2005/0028980 | A1 | 2/2005 | Page et al. | |
| 2007/0181299 | A1 | 8/2007 | Chung et al. | |
| 2007/0289749 | A1 | 12/2007 | Wood et al. | |
| 2009/0101330 | A1 | 4/2009 | Johnson | |
| 2010/0270031 | A1 | 10/2010 | Patel | |
| 2011/0127035 | A1 * | 6/2011 | Hansen | E21B 47/12 166/297 |
| 2012/0136579 | A1 | 5/2012 | Kvernvold | |
| 2013/0133883 | A1 | 5/2013 | Hill, Jr. | |
| 2013/0299165 | A1 | 11/2013 | Crow | |
| 2016/0097274 | A1 * | 4/2016 | Duphorne | E21B 47/1015 250/260 |
| 2017/0350234 | A1 * | 12/2017 | Xia | E21B 47/06 |
| 2018/0073352 | A1 * | 3/2018 | Potapenko | E21B 47/10 |
| 2018/0274356 | A1 * | 9/2018 | Hazel | E21B 33/13 |

FOREIGN PATENT DOCUMENTS

| | | | |
|---|---|---|---|
| WO | 2006127274 | A1 | 11/2006 |
| WO | 2014022384 | A1 | 2/2014 |
| WO | 2015023190 | A1 | 2/2015 |

* cited by examiner

APPARATUS FOR MONITORING AT LEAST A PORTION OF A WELLBORE

BACKGROUND

The present disclosure incorporates the entire disclosure of PCT Application Publication No. WO 2016/200266 A1 for all purposes, including specifically the entire disclosure relating to the disclosed embodiments of the apparatus.

The present disclosure relates to monitoring of a wellbore, and in particular to monitoring and determining properties of leakages and/or detecting leaked material from such barriers, such as fluid which may leak from a formation through a barrier in a permanently and/or temporarily abandoned well.

When wells are to be abandoned or plugged, barriers are typically installed deep in the wellbore in the Earth's subsurface to prevent for example fluids from propagating up the wellbore and out of the well at the surface. The barriers may be provided with a view of staying there permanently, or temporarily for a period of time, until the wellbore is put to use later on. Typically, the barriers are designed to be long-term solutions for example to seal the well for a period of months, years or permanently. The barriers are required to seal the wellbore to withstand the pressure of fluids below the barrier and prevent fluids from travelling up to the surface via the wellbore. A particular application for such barriers is in wells that have been used in the exploration and production of oil and gas, or water and/or gas injection wells which may for example be applied to facilitate such exploration and production activities. Barriers of similar sort are used in wells in other industries, such as in wells which may be used to store radioactive waste or the like within the Earth's crust, and may also be applied in gas storage wells, $CO_2$ storage wells or geothermal wells.

Requirements and procedures for plugging and abandoning wells are regulated by standards predicted by governmental authorities in respective countries. Standards for plugging and abandoning wells in Norway are set out in the standard Norsok D-010. Barriers established in order to seal off reservoir sections in wells may be separate or combined, and have to be tested accordingly. Such barriers are typically formed from cement, by inserting cement slurry into the wellbore and leaving it to set, although other materials can be used such as SANDABAND™ and/or molten alloy sealing materials, and mechanical plugging devices can also be used to provide barriers.

The requirements also make it necessary for each of the barriers to provide a so-called full bore seal. In order to do so, permanently and temporarily abandoned wells have commonly been provided with barriers which are installed in open-hole, uncased sections of the wellbore, or in sections where casing has been removed, e.g., by milling or pulling out sections of casing. Increasingly however, it has been of interest to permanently abandon wells in cased sections without removing casing sections, for example to save costs and/or to facilitate re-use of the abandoned wellbore several years later. The barriers must then typically seal the wellbore, the formation annulus between the outside of the casing and the formation, and any casing annulus between two casings.

A large number of wells throughout the world are candidates for different types of abandonment.

Although a wellbore may have barriers installed to sufficient standards, leakages are sometimes experienced after a period of time, e.g. shortly after installation or after a period of several months or years. If the leakages are substantial, remedial work may be required.

In cased wellbores, a particular difficulty is that there are multiple potential leakage paths which arise, such as along the outer surface of the casing, between the casing and the formation and/or between two adjacent casings. If the seal between the casing and the formation is leaky, fluids from below the barrier may migrate upward along the outer surface of the casing to the surface. This may cause undesired contamination into the environment, e.g. into the sea in the case of offshore wells. There may also be a risk of leaking fluids entering groundwater reservoirs, and causing undesired contamination of water to be supplied to consumers.

While keeping the casing in the wellbore can be beneficial on one hand, the leakage behaviour may be more complicated due to the presence of casings, and remedial work may be more difficult.

In light of this above there is a need for better understanding the leakage behaviour of barriers in abandoned wells, and to reliably detect leaking barriers, or components thereof, in order that remedial actions can be taken.

SUMMARY

It is therefore provided an apparatus for monitoring at least a portion of a wellbore, the apparatus comprising a body having at least an anchoring means for releasably positioning the apparatus with respect to a tubular in the wellbore; characterized in that the apparatus comprises detecting means for detecting at least one parameter of a substance in the portion, and in that the apparatus comprises transceiver means configured to at least transmit data related to the parameter.

The body may comprise a mandrel having an axially extending, through-going, internal bore having respective first and second openings, and the anchoring means and releasable sealing means may be arranged on the body between the openings and configured to abut against a portion of the tubular internal wall. A sealing and removable material may be extending axially through the body.

In one embodiment, at least an axial portion of the bore is filled with a sealing and removable material, whereby the apparatus is a plugging device. In one embodiment, drilling alignment means may be arranged in or in the vicinity of the first, upper, opening.

The drilling alignment means may comprise a circular element arranged around the first, upper, opening; or a funnel-shaped profile in an upper portion of the bore; or both.

In one embodiment, the transceiver means comprises a wireless transmitter and receiver; for example an acoustic transmitter and receiver, or an electromagnetic transmitter and receiver.

The detecting means may comprise at least one sensor; for example one or more of a pressure sensor, a temperature sensor, a resistivity sensor.

In one embodiment, the sealing and removable material comprises a capillary tube extending an axial distance inside the sealing and removable material, and having a first, open, end in the vicinity of the through-going bore second opening, and a second, closed end inside the sealing and removable material.

Also disclosed is a wellbore having or more wellbore barriers, where at least one of the barriers comprises an apparatus according to the disclosure.

The wellbore may comprise a plurality of apparatuses and an apparatus in one barrier may be configured to communicate with at least an apparatus in another barrier via the transceiver means.

It is also provided a method of transmitting signals in a wellbore by means of a plurality of apparatuses according to the disclosure, characterized by a first apparatus emitting at least a unique identification signal;

a second apparatus, arranged farther uphole than the first apparatus, receiving at least the unique identification signal.

In the method, the signal is transmitted via an intermediate apparatus. In another embodiment of the method, the signal is transmitted past an intermediate, non-functioning apparatus.

In the method, data signals related to parameters sensed by the sensors are emitted by the first apparatus and received by the second apparatus.

There is also provided apparatus for detecting leaked material from at least one barrier of a well, the well comprising a wellbore, the apparatus comprising:

at least one containing device configured to be disposed in the wellbore to contain the leaked material from the barrier in at least one region of the wellbore; and at least one detecting device configured to be mounted in the wellbore for detecting the material in the region.

There is also provided a method of detecting leaked material from at least one barrier of a well, the well comprising a wellbore, the method comprising:

(a) providing at least one containing device in the wellbore to contain the leaked material in at least one region of the wellbore; and (b) using at least one detecting device to detect the contained material, the detecting device being mounted in the wellbore.

The containing device may comprise at least one sealing device arranged to seal against a wall of the wellbore. The sealing device may substantially fluidly isolate adjacent regions of the wellbore on either side of the sealing device.

The apparatus may further comprise a body, for example an elongate body such as a mandrel or the like, which may be tubular, for supporting the containing device. In particular variants, the containing device comprises first and second containing devices. The first and second containing devices may be configured to be spaced apart along the wellbore, when disposed therein. Accordingly, the containing devices may typically be spaced apart from one another along the body. The region of the wellbore may be defined between the first and second containing device. At least one lining-tubular of the wellbore, e.g. a casing or lining, may be provided with an opening such that the leaked material enters the region between the first and second containing devices through the opening.

In this variant, leaked fluid from the barrier may enter the wellbore through a region outside the lining or casing. The lining or casing may comprise at least one casing or other lining for lining the wellbore.

Preferably, the detecting device may comprise at least one sensor. The sensor may typically be mounted on the body.

Alternatively, the detecting device may comprise at least one tube mounted in the wellbore, and at least one sensor provided at the surface, i.e. at or above the top of the well, wherein the tube is arranged to provide fluid communication between the region of the wellbore and the sensor so that the sensor can detect the leaked material in the region.

The region between the first and second sealing elements may be a first region, and the wellbore may further have a second region for containing the fluid between the first sealing element and the barrier. Leaked fluid from the barrier may enter into either or both of the first and second regions. Accordingly, in particular embodiments, the leaked fluid entering the first region may enter the wellbore through a region outside the lining or casing. In such embodiments, the leaked fluid entering the second region may enter the wellbore inside the lining or casing. The detecting device may comprise at least one sensor arranged to detect the leaked fluid which is contained in either or both of the first and second regions.

The wellbore may be lined by at least one lining or casing comprising first and second lining or casing sections, wherein the second lining or casing section has a greater diameter than the first lining or casing section. The first containing device may then be arranged to seal against the first casing section. The second containing device may then be arranged to seal against the second casing section.

The detecting device may be used to measure any one or more of: resistivity; capacitance; pressure; temperature; and radioactivity. The detecting device may be used to detect an interface, such as a fluid interface. The detecting device may comprise at least one sensor for detecting energy returned from the fluid interface.

The body may be provided with at least one bore for inserting barrier remedial material through the bore into the wellbore in the event of detecting the leaked fluid.

In embodiments where a sensor is mounted in the wellbore, the apparatus may further comprise data communication means for communicating data from the sensor to the surface. The data communication means may comprise a data transfer line such as a fibre optical cable or electrical line, or via a wireless link.

The apparatus may be supplied with electrical power. Electrical power may be employed to operate the sensor and/or to activate or operate other components.

The material may typically comprise fluid, such as hydrocarbon fluids such as oil and gas. The material may include for example particles, which may be part of and/or carried in the fluid and/or which may have some detectable characteristic. The fluid may contain a tracer which may for example be introduced to the fluid at the barrier. The sensors may thus detect the tracer, or chemical component in the fluid.

The well may be of any type described herein. For example, the well may be an abandoned well.

The barrier may comprise at least one plug. The plug may comprise a body of cement or other material which may be pumped in in a flowable condition and left to set. The plug may be mechanically operable, or may be formed by inserting plugging material which expands to plug the well.

The fluid may typically leak from the formation through the barrier.

There is also provided a method of monitoring at least one well, the well being plugged by at least one barrier, the well comprising a wellbore, the method comprising:

applying at least one containing device in the wellbore so that material entering the wellbore from the barrier is contained in at least one region of the wellbore; and using at least one detecting device to detect material in at least one region of the wellbore, the detecting device being mounted in the wellbore.

According to a fourth aspect of the disclosure there is provided an apparatus for performing the method of the third aspect.

There is also provided an apparatus for determining at least one property of leakage from at least one barrier of a well, the well comprising a wellbore, the apparatus comprising:

at least one containing device for containing material in at least one region of the wellbore; and at least one sensor for detecting the contained material, or at least one characteristic thereof.

The region may be in communication with the barrier whereby leaking material from the barrier can be contained and/or accumulate in the region, e.g. by the leaking material migrating from the barrier into the region.

The property of leakage from the barrier may be any of:

the presence, or not, of a leak or of leaked material;

leakage rate;

the size of leak;

the location of leak;

the amount or type of material leaked; and at least one property for quantifying a leak.

The characteristic of the contained material may comprise a physical or chemical property or other property for characterizing or identifying the fluid.

The sensor may be used to measure any one or more of: resistivity; capacitance; pressure; temperature; and radioactivity.

The sensor may be used to detect an interface, such as a fluid interface. The sensor may be arranged for detecting energy returned from the fluid interface.

There is also provided a method of determining at least one property of leakage from at least one barrier of a well, the well comprising a wellbore, the method comprising:

providing at least one containing device in the wellbore for containing material in at least one region of the wellbore; and using at least one sensor for detecting the contained material, or at least one characteristic thereof, to detect the property of leakage.

The region may be in communication with the barrier whereby leaking material from the barrier can be contained and/or accumulate in the region, e.g. by the leaking material migrating from the barrier into the region.

The property of leakage from the barrier may be any of:

the presence, or not, of a leak or of leaked material;

leakage rate;

the size of leak;

the location of leak;

the amount or type of material leaked; and at least one property for quantifying a leak.

The characteristic of the contained material may comprise a physical or chemical property or other property for characterizing or identifying the fluid.

The sensor may be used to measure any one or more of: resistivity, capacitance, pressure, temperature, and radioactivity. The sensor may be used to detect an interface, such as a fluid interface. The sensor may be arranged for detecting energy returned from the fluid interface.

The method may further comprise installing the apparatus of the fifth aspect in the wellbore.

There is also provided a method of monitoring at least one well, the well being plugged by at least one barrier, comprising using the apparatus of the fifth aspect in the wellbore.

There is also provided apparatus for determining at least one property of leakage from at least one barrier of a well, the well comprising a wellbore provided with lining or casing, the apparatus comprising:

at least one first sensor for detecting material in a first region along the wellbore, at least one second sensor for detecting material in a second region along the wellbore, the material to be detected in the first region entering via a first path on an outside of the lining or casing, and the material to be detected in the second region entering via a second path on an inside of the lining or casing.

The apparatus may comprise at least one containing device for containing the material in the first and second regions.

There is also provided a method of determining at least one property of leakage using the apparatus of the eighth aspect.

Any of the abovementioned aspects of the disclosure may include further features as described in relation to any other aspect, wherever described herein. Features described in one embodiment may be combined in other embodiments. For example, a selected feature from a first embodiment that is compatible with the arrangement in a second embodiment may be employed, e.g. as an additional, alternative or optional feature, e.g. inserted or exchanged for a similar or like feature, in the second embodiment to perform (in the second embodiment) in the same or corresponding manner as it does in the first embodiment.

Embodiments of the disclosure are advantageous in various ways as will be apparent from the specification throughout.

The apparatus provides an alternative to the traditional mechanical plug below the cement of the surface barrier, or the surface barrier itself, and makes it possible for the operator to complete the entire plugging and abandonment (P&A) operation in the well and be able to monitor it after the P&A procedure has been completed. The apparatus comprises monitoring via wireless transmission to the surface, as well as re-entry means. In an example application, it may be useful to monitor plugged wells for a period of minimum two years in order to verify the overall integrity of the installed barriers during the P&A operation. In case of contingencies, monitoring will ensure detection at an early point in time allowing remediation of the well before it is too late.

BRIEF DESCRIPTION OF THE DRAWINGS

There will now be described, by way of example only, embodiments of the disclosure with reference to the accompanying drawings, in which.

DETAILED DESCRIPTION

Figure 1:
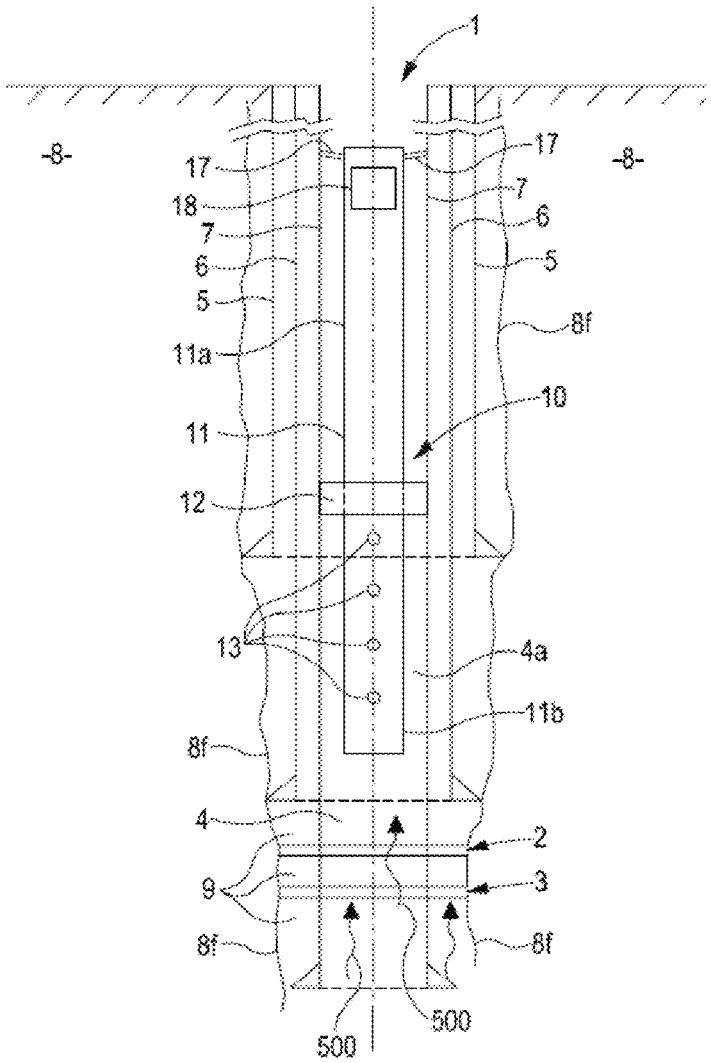
FIG. 1 is a schematic representation of apparatus for detecting a fluid which has leaked through a barrier in a wellbore according to an embodiment.

With reference to FIG. 1, a well 1 is depicted which is plugged with two barriers 2, 3. Apparatus 10 is located in a wellbore 4 of the well 1 for detecting leaking fluid 500 from the barriers 2, 3. The wellbore 4 extends into the subsurface 8 including one or more geological formations 8*f* containing fluid. The well 1 in this example is one which has been in used previously for extracting oil or gas from the subsurface, where the barriers 2, 3 are applied for abandoning the well 1. Fluid which is present in the subsurface under pressure has passed from the formation 8*f* through the barriers 2, 3 into the wellbore 4. The fluid in this example includes hydrocarbon fluids in the form of oil and gas. The leaking hydrocarbon fluids are depicted at 500 as leaking into the wellbore 4. The barriers 2, 3 include are spaced apart from one another, one above the other.

In the example of FIG. 1, the wellbore 4 is cased by outer casing 5, intermediate casing 6, and inner casing 7. The wellbore 4 extends into the subsurface 8, and can be accessed in the space within the innermost casing 7, allowing the apparatus 10 to be deployed and installed within the wellbore 4.

Each of the casings 5, 6, 7 is tubular in shape and typically has several sections placed end to end in succession along the bore 4. The inner casing 7 in this case may be standard 9⅝" casing.

The intermediate casing 6 is arranged concentrically within the outer casing 5 and the inner casing 7 is in turn arranged concentrically within the intermediate casing 6. Securing material such as cement or the like, is present around the outside of the respective casings 5, 6, 7 having been used, as is typically the case, to secure the casings 5, 6, 7 in place during construction of the well 1 and to prevent flow in the different annuli. In this way, a structure of alternating layers of the casings 5, 6, 7 and securing material provides a wall for the wellbore 4.

Each of the barriers 2, 3 is configured for plugging the wellbore 4 inside the inner casing 7 and for plugging an annular region 9 between the inner casing 7 and a geological formation 8*f* of the subsurface 8.

The apparatus 10 is situated in the wellbore 4, being installed above the plugs 2, 3. The apparatus 10 has a body in the form of an elongate mandrel 11 and a containing device in the form of a sealing device 12 which is mounted on the elongate mandrel 11. The sealing device 12 seals an annulus between the mandrel 11 and the casing 7. The apparatus 10 is mounted so as to be secured to the wellbore 4 via anchors 17. The anchors 17 are arranged on the mandrel 11 and configured to engage with the wall of the wellbore 4, e.g., upon activation. The anchors 17 may have gripping surfaces to grip the wall of the wellbore 4. The anchors 17 are configured to support the weight of the apparatus 10 and to withstand pressure or forces exerted upon the apparatus 10, e.g., caused by influxes of fluid leaking from the formation through the barriers 2, 3 into the wellbore 4. The sealing device 12 seals against an inner surface of the inner casing 7. In this way, the sealing device 12 acts to contain fluid in a region 4*a* of the bore 4 below the sealing device 12. The apparatus 10 includes sensors 13 which are arranged for measuring one or more properties of the fluid contained in the region 4*a*. The sensors 13 are spaced apart from one another along the bore 4, positioned below the sealing device 12, on a lower portion of the mandrel 11*b*.

Hydrocarbon fluid 500 leaking into the region 4*a* through the plugs 2, 3 can be detected by the sensors 13. It can be noted that upon installing the apparatus 10 in the wellbore 4, the region 4*a* typically contains one or more other well fluids such as brine, water, mud (e.g. old drilling mud), or another "heavy" fluid. Therefore, the leaking hydrocarbon fluid 500 tends to migrate naturally upward in the region 4*a* due to it having a lesser density than the other well fluid or fluids. The hydrocarbon fluid 500 will therefore tend to collect or accumulate adjacent to the sealing device 12 on the underside thereof. Over time, an interface between the hydrocarbon fluid 500 and the other well fluid may form and move downward from the sealing device 12, along the lower portion of the mandrel 11*b*. As the hydrocarbon fluid enters the region 4*a*, the pressure and temperature in the region 4*a* will also tend to increase depending somewhat upon the type of fluids contained in the region 4*a*.

The accumulation of hydrocarbon fluid 500, and/or any such interface which may form, can be detected using the sensors 13. The sensors 13 in this example include fluid type sensors in the form of, for example, resistivity or capacitance sensors for determining the resistivity or capacitance of the fluid within range of the sensors 13. It will be appreciated that measurements of the resistivity or capacitance can be indicative of the type of fluid, e.g., the hydrocarbon fluid 500, as the values will be different compared with for example that of the other well fluid, such as brine or the like. Thus, the presence of the sensors 13 can allow hydrocarbons to be discriminated from the other fluid that may be present. The sensors 13 preferably also include a pressure sensor for measuring the pressure in the region 4*a* and/or a temperature sensor for measuring the temperature in the region 4*a*. An increase in temperature and pressure in the region 4*a* will typically take place as hydrocarbon fluid enters into the region 4*a* and such increases can be detected by measuring the pressure and temperature in the region 4*a* using the sensors 13. The combined use of the fluid-type sensors together with pressure and/or temperature sensors can thus help to determine with greater certainty whether a leak through the barriers 2, 3 has occurred. In addition, it can be noted that the pressure in the region 4*a* in the event of gas leaking into the region 4*a* is typically different than if oil has leaked into the region 4*a*. Therefore, the use of resistivity or capacitance sensors, or the like, in combination with a pressure sensor can allow additionally the type of fluid leaking into the region 4*a* to be determined.

The apparatus 10 includes an electronics package 18 including a computer device for processing and storing data obtained from the sensors 13. The data can be accessed remotely, while the apparatus 10 is deployed in the wellbore 4, from the surface by communicating the data from the apparatus 10 uphole to the surface. This can be performed by running a data retrieval probe (not shown) on a communication line into the wellbore 4 into proximity to the apparatus 10. The data may then be transferred from the electronics package 18 through the probe and communicated to the surface via the communication line. The probe may connect wirelessly with the electronics package 18 to retrieve the data from the memory in the electronics package 18. The probe may connect via a pin-less connector. This arrangement can facilitate convenience and speed of data retrieval. In other variants, a cabled solution with a physical plug for connecting the communication line to the apparatus may be provided for accessing the data. Real-time transmission of data uphole to the surface may also be provided where data is fed more or less continuously up to the surface as it is obtained (e.g. without being stored in memory on the apparatus 10), through a communication line (e.g. optical or electrical) between the apparatus and surface equipment, or by wireless communication.

The electronics package 18 may also include one or more controllers for activating the anchors 17 and for activating the sealing device 12. In practice, the apparatus 10 may be run into the wellbore 4 on a running string or the like, which is subsequently detached, leaving the apparatus 10 in the well 1. When being run in, the sealing devices 12 may be in a collapsed form so as not to interfere with the insertion into the well 1. Similarly, the anchors 17 may be retracted. When connected to the running string and positioned at the desired installation location along the wellbore 4, a control signal may be applied via the controller(s) and used to activate the anchors 17 to engage with the wall of the wellbore 4 for securing the apparatus 10 in place. This may cause the anchors 17 to extract from the mandrel 11 into contact with the casing 7. In addition, a control signal may be applied to cause the sealing device 12 to form a seal for containing the fluid in the region 4*a* in the wellbore 4. Once this is done, and the apparatus 10 is in place, the running string may be removed.

In order to operate electrical components, power can be supplied from a battery incorporated in the apparatus 10, e.g. in part of the electronics package 18. Such a battery may be used to provide power to the computer device, the sensors 13, data transmission or communication devices. In certain variants however, instead of a battery, a wire between the apparatus 10 and the surface may be provided for delivering power from a power source at the surface through the wire to the apparatus 10. In certain variants, signals can be delivered for activating, e.g., the anchors 17 or the sealing devices 12 by optical fibre line between the apparatus 10 and the surface.

In use therefore, the apparatus 10 is inserted and installed in the bore 4 such that the sealing device 12 seals against the inner casing 7. Thus, even small quantities of the hydrocarbon fluid 500 leaking into the region 4*a* below the sealing device 12 can accumulate in the region 4*a*. The sensors 13 are used for measuring properties of the fluid in the region 4*a* so as to detect hydrocarbons that have leaked through the plugs 2, 3. The speed of accumulation of the hydrocarbons 500 may also be determined by data from the sensors 13, by determining the time of detection at successive known sensor locations or determining the position of the interface, hence a leak rate can be identified. In addition, the type of leaking fluid can be determined.

It will be noted that to operate the sensors 13, the electronics package 18 is connected to the sensors 13 by for example connecting wires, although such wires are not shown in the figures.

Figure 2:
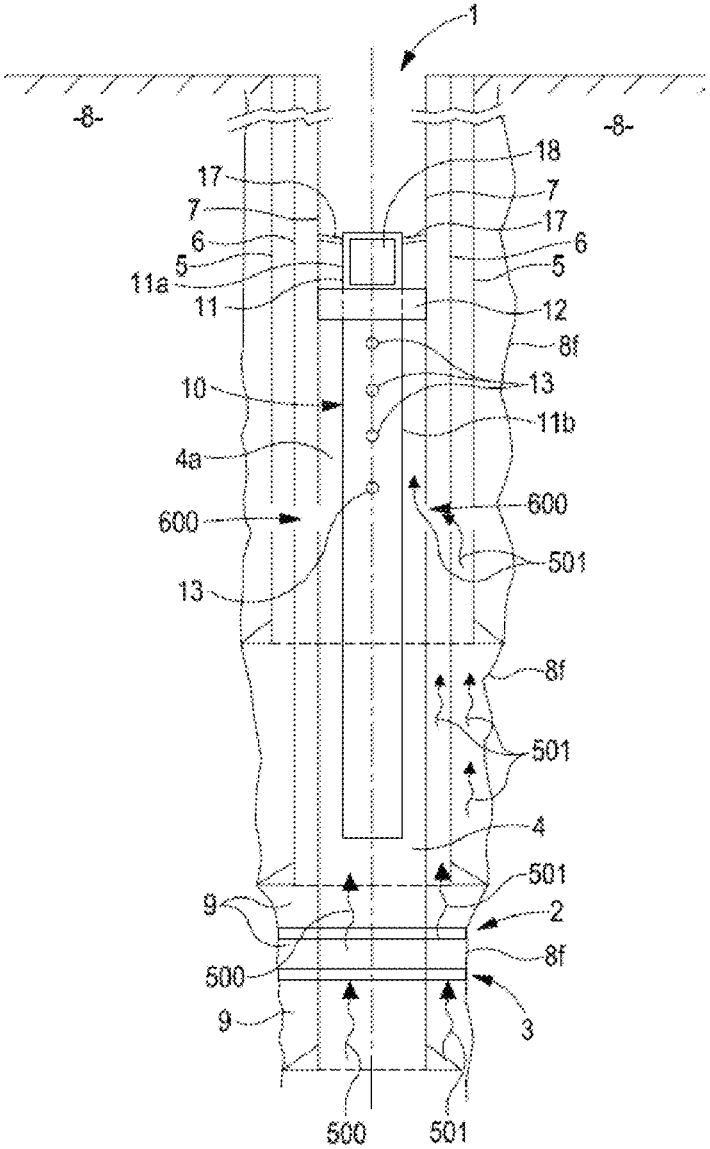
FIG. 2 is a schematic representation of apparatus for detecting a fluid which has leaked through a barrier in a wellbore according to another embodiment.

With reference now to FIG. 2, the apparatus 10 is applied in the well 1 in the same way as described in relation to FIG. 1, except that the well 1 has prepared openings in the form of perforations 600, which penetrate through walls of the casings 5, 6, 7. The apparatus 10 is positioned within the bore 4 above the perforations 600. This allows hydrocarbon fluid which may migrate upward along a path outside the inner casing 7 to enter the region 4*a* through the perforations 600, as indicated by arrows 501. In this way, hydrocarbons may accumulate in region 4*a* on the underside of the sealing device 12 as a result of upward migration through the plugs 2, 3 both into the interior of the inner casing 7 and into a region in the annulus 9 around the inner casing 7. The sensors 13 can be employed in the same way as described above under the description of FIG. 1, to detect hydrocarbons and determine the presence or rate of accumulation of those hydrocarbons, as an indication of a leaky barrier, or rate of leakage in the barrier. An advantage of the embodiment of FIG. 2 is that the apparatus 10 can additionally detect leakage through the barriers 2, 3 along a path in the annulus 9. The perforations 600 may typically be formed by perforating the casings 5, 6, 7, before inserting the apparatus 10 in the bore 4.

Sensors 13 are preferably positioned so that an influx of fluid from the annular region into the region 4*a* can be readily detectable.

Figure 3:
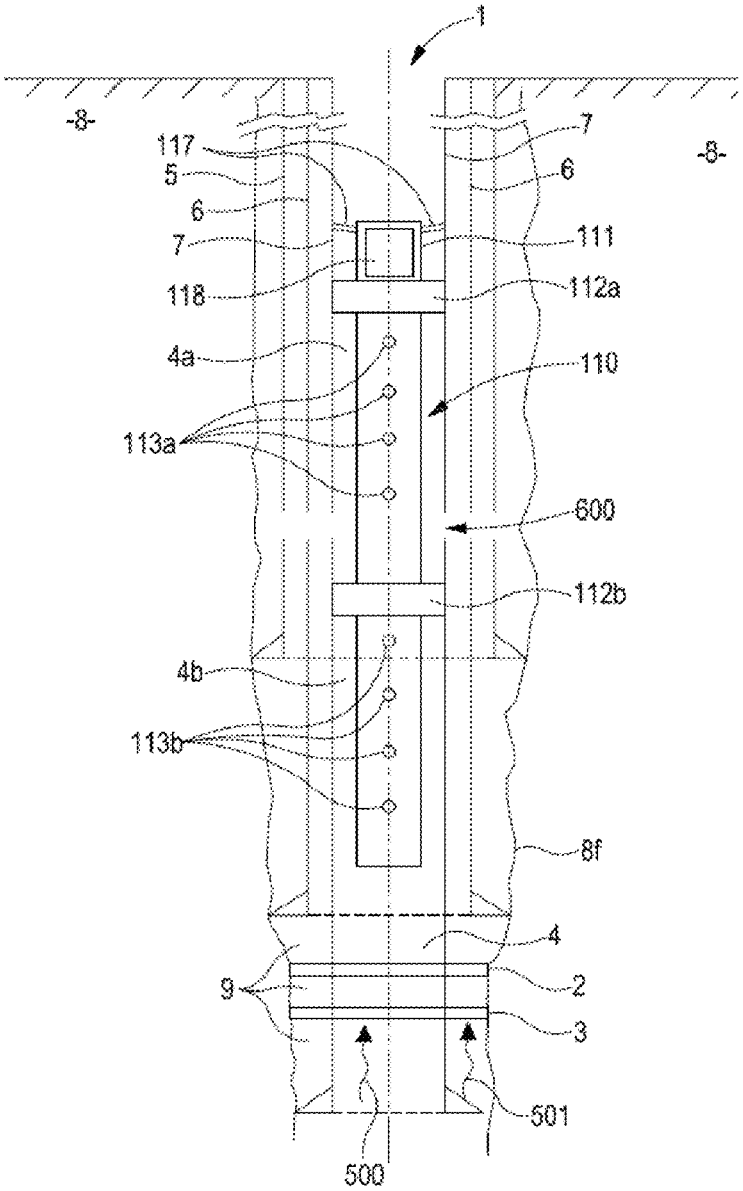
FIG. 3 is a schematic representation of apparatus for detecting a fluid which has leaked through a barrier in a wellbore, prior to the fluid leaking through the barrier, according to another embodiment.
Figure 4:
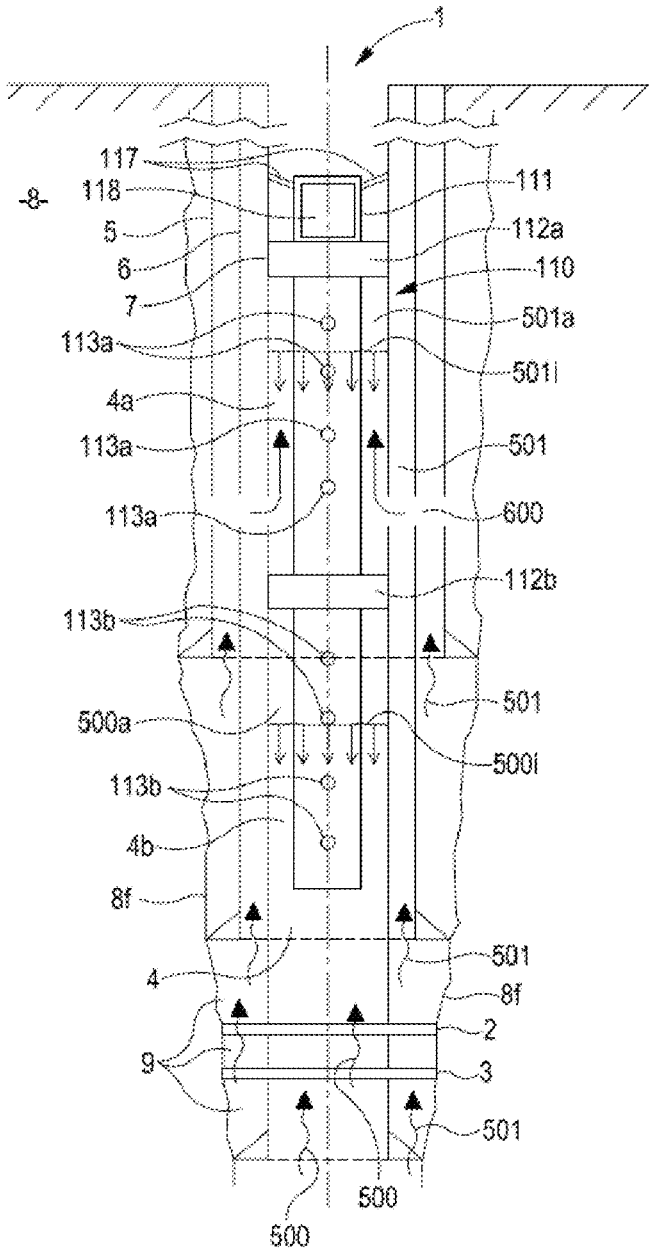
FIG. 4 is a schematic representation of the apparatus of FIG. 3 after fluid has leaked through the barrier.

Referring now to FIGS. 3 and 4, another example is shown wherein an apparatus 110 is deployed in the wellbore 1 which is provided with perforations 600 through the walls of the casings 5, 6, 7. The apparatus 110 has a body in the form of a mandrel 111 provided with a first sealing device 112*a* and a second sealing device 112*b* spaced apart from one another along the mandrel 111. Anchors 117 are provided being operable in the same way as the anchors 17 described in relation to FIGS. 1 and 2.

The apparatus 110 is set in the wellbore 4 so that the first sealing device 112*a* is arranged above the location of the perforations 600 and the second sealing device 112*b* is arranged below the location of the perforations 600. Sensors 113*a* are arranged along the mandrel 111 on the underside of the sealing device 112*a*. Sensors 113*b* are arranged along the mandrel 111 on the underside of the sealing device 112*b*. The sensors 113*a* are configured in the same way as the sensors 13 of the apparatus 10 described above in relation to FIGS. 1 and 2. Similarly, the sensors 113*b* are configured in the same way as the sensors 13 of the apparatus 10. A first region 4*a* is defined within the inner casing 7 between the first and second sealing devices 112*a*, 112*b*. A second region 4*b* within the inner casing 7 is defined between the second sealing device 112*b* and the barrier 2. The sensors 113*a* are arranged to sense properties of fluid in the first region 4*a*, and the sensors 113*b* are arranged to sense properties of fluid in the second region 4*b*. The apparatus 110 also includes an electronics package 118 as described in the same way as the electronics package 18 described in relation to FIGS. 1 and 2, although the package 118 in this case is configured to process and facilitate communication of data from two sets of sensors 113*a*, 113*b*.

As seen best in FIG. 4, hydrocarbon fluid may migrate upward as indicated by arrows 501 as a result of leakage in the barrier on the outside of the inner casing 7 and collect in an upper volume 501*a* of the first region 4*a*. Over time an interface 501*i* between the collecting hydrocarbon fluid and the other well fluid will tend to move downward. The sensors 113*a* may thus be employed to detect the leakages from an element of the barriers 2, 3 through the region surrounding the inner casing 7.

Hydrocarbon fluid may also migrate upwards from the barrier as indicated by arrows 500 on the inside of the inner casing 7 and collect in an upper volume 500*a* of the second region 4*b*. Over time an interface 500*i* between the collecting hydrocarbon fluid and the other well fluid in the region 4*b* will tend to move downward. The sensors 113*b* may thus be employed to detect the leakages from elements of the barriers 2, 3 through the region within the inner casing 7.

This configuration, as shown in FIGS. 3 and 4, can be beneficial in that it makes it possible to distinguish between leakage paths on the inside and outside of the casing 7, and thus to determine better what parts of the barriers 2, 3 may be faulty.

Figure 5:
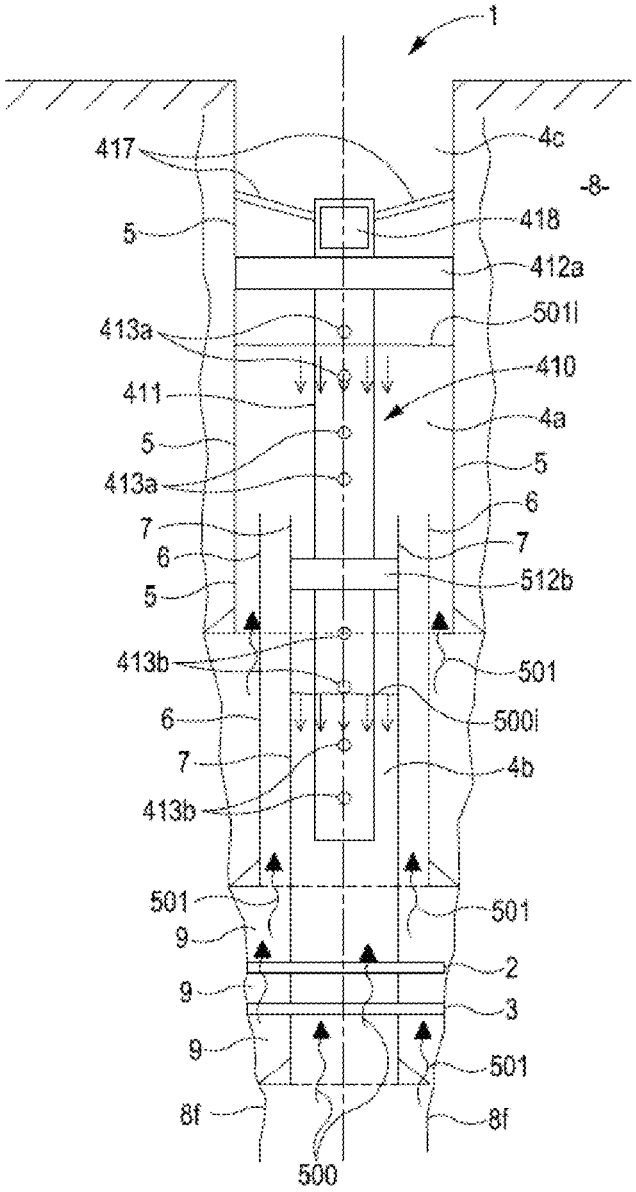
FIG. 5 is a schematic representation of apparatus for detecting a fluid which has leaked through a barrier in a wellbore according to another.

In FIG. 5, apparatus 410 is deployed in the well 1. The apparatus 410 is basically identical to the apparatus 110 in FIGS. 3 and 4, except in this example, the apparatus 410 has a first sealing device 412*a* which seals against the casing 5. In order to install the apparatus 410, upper sections of the casings 6 and 7 are cut, leaving the wellbore 4 with only the outer casing 5 along an upper region 4*a* of the wellbore 4. The casings 6, 7 can be cut by various methods such as for example abrasive jetting, and the cut section can then be pulled out.

The sealing devices 412*a*, 412*b* thus engage and seal against different casings which have different diameters. More specifically, in this example, the sealing device 412*a* engages and seals against the outer casing 5, and the sealing device 412*b* engages and seals against the inner casing 7.

The sealing device 412*a* is thus configured to contain fluid in the region 4*a* in which the fluid 501 can collect. The fluid 501 may include fluid which has migrated along the wellbore 4 on the outside of the casing 7, for example in an annulus between the casing 7 and the casing 6, and/or an annulus between the casing 6 and the casing 5. The sealing device 412*b* prevents fluid in the region 4*b* from migrating into the region 4*a*. The sensors 413 can be employed as the sensors 13 in the apparatus 10 of the embodiments above, and detect the fluid contained in the region 4*a* for example by detecting the interface 501*i*. Accordingly, this arrangement allows leak paths from the barrier outside and inside the casing 7 to be distinguished, and facilitates reliable collection and detection of fluids that migrate upward in the annuli outside the casing. An electronics package 418 operating as those described above is provided.

In variants of the apparatus 410 of FIG. 5, a shoulder (not shown) may be provided to protrude radially outwardly from the mandrel such that the shoulder abuts against the cut end of the casing sections 6, 7 to position the apparatus in the wellbore 10. The shoulder may then act to stop the apparatus in the correct position within the wellbore 4 when being deployed into the wellbore 4. The cut portion of the wall structure can thus be used as a landing foundation onto which the apparatus is landed when being installed. In such a variant, the anchor 417 seen in the apparatus 410 could be omitted.

Figure 6:
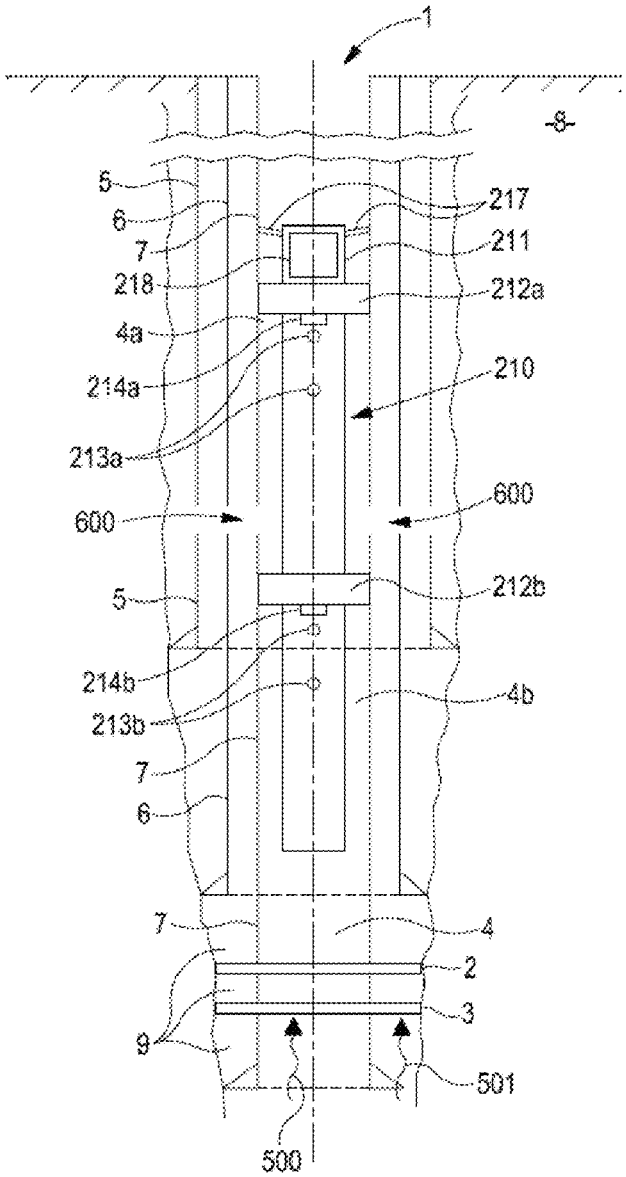
FIG. 6 is a schematic representation of apparatus for detecting a fluid which has leaked through a barrier in a wellbore, prior to the fluid leaking through the barrier, according to another embodiment.
Figure 7:
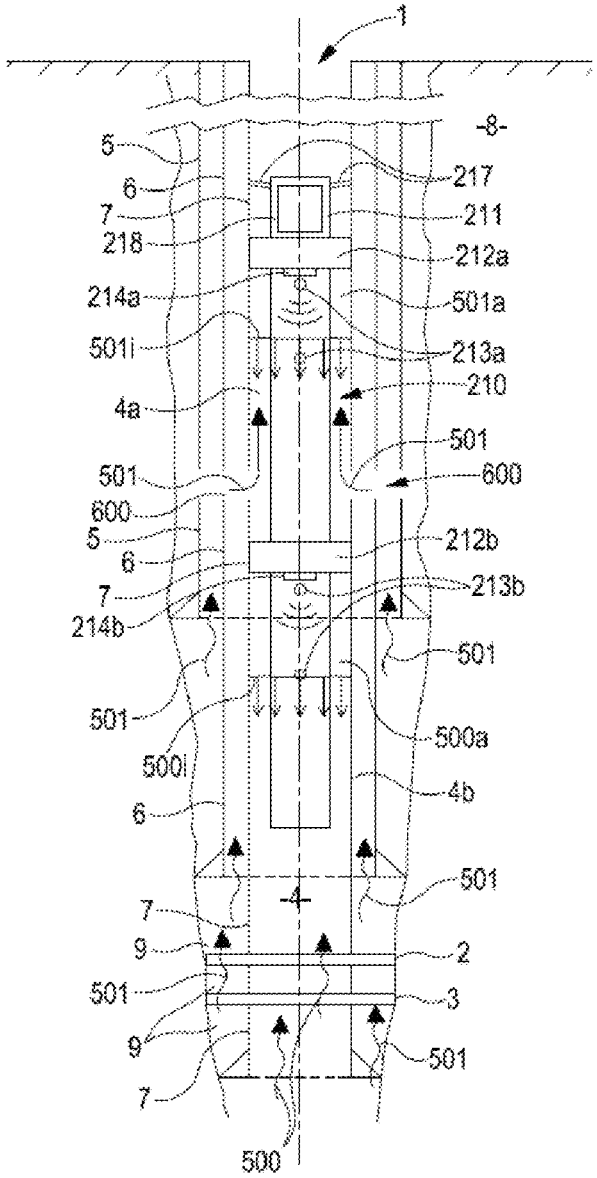
FIG. 7 is a schematic representation of the apparatus of FIG. 6 after fluid has leaked through the barrier.

Turning now to FIGS. 6 and 7, yet another example is shown wherein an apparatus 210 is deployed in the well 1 which is provided with perforations 600 through the walls of the casings 5, 6, 7. The apparatus 210 has first and second sealing devices 212*a*, 212*b* provided on a mandrel 211 and is positioned in the wellbore 4 such that these first and second sealing devices 212*a*, 212*b* are positioned on either side of the location of the perforations 600, so that hydrocarbon fluid 500, 501 migrating upward in the same way as described above in relation to FIGS. 3 and 4 can be contained in the first and second regions 4*a*, 4*b* of the wellbore 4, on the undersides of the first and second sealing devices 212*a*, 212*b*. Downward moving interfaces 500*i*, 501*i* are formed over time as increasing amounts of the hydrocarbon fluids enter the regions 4*a*, 4*b* from the barriers below 2, 3 and are contained by the sealing devices 212*a*, 212*b*.

In this example, the apparatus 210 additionally has radar transmitters 214*a*, 214*b* for transmitting electromagnetic waves toward the interfaces 500*i*, 501*i*. Electromagnetic energy returning from the interfaces 500*i*, 501*i* in response to the transmission is sensed by sensors 213*a*, 213*b*, such that data are obtained from the sensors 213*a*, 213*b* for determining the position or change in position of the interface 500*i*, 501*i* with time. Each group of sensors 213*a*, 213*b* may further include a pressure sensor and a temperature sensor. The respective groups of sensors 213*a*, 213*b* may further include a fluid-type sensor in the form of a resistivity and/or a capacitance sensor, and an electromagnetic sensor for sensing the returning electromagnetic energy in one or more locations along the mandrel 211.

In other variants, other transmitter-sensor techniques could be used. For example, instead of transmitting electromagnetic energy, acoustic or sonic energy may be transmitted toward the interface 500*i*, 501*i*, and reflections from the interface detected in order to determine its position. In such cases therefore, it will be appreciated that the apparatus 210 may be applied with acoustic or sonic transmitters replacing, or being applied together with, the radar transmitters 214*a*, 214*b*, and providing suitable acoustic or sonic sensors.

By detecting the interfaces 500*i*, 501*i* and monitoring their movement in this way, the rate of hydrocarbon build-up over time can be determined as an indicator of the rate of leakage. In this example, isolating the first and second regions of the wellbore 4 by means of the sealing device 212*b*, advantageously allows the build-up of leaked hydrocarbon fluids to be monitored and rates of leakage for the leakages through the barriers 2, 3 on the inside of the inner casing 7 and on the outside of the inner casing 7. An electronics package 218 and anchors 217 are provided in the same way as those in the examples described above.

Figure 8:
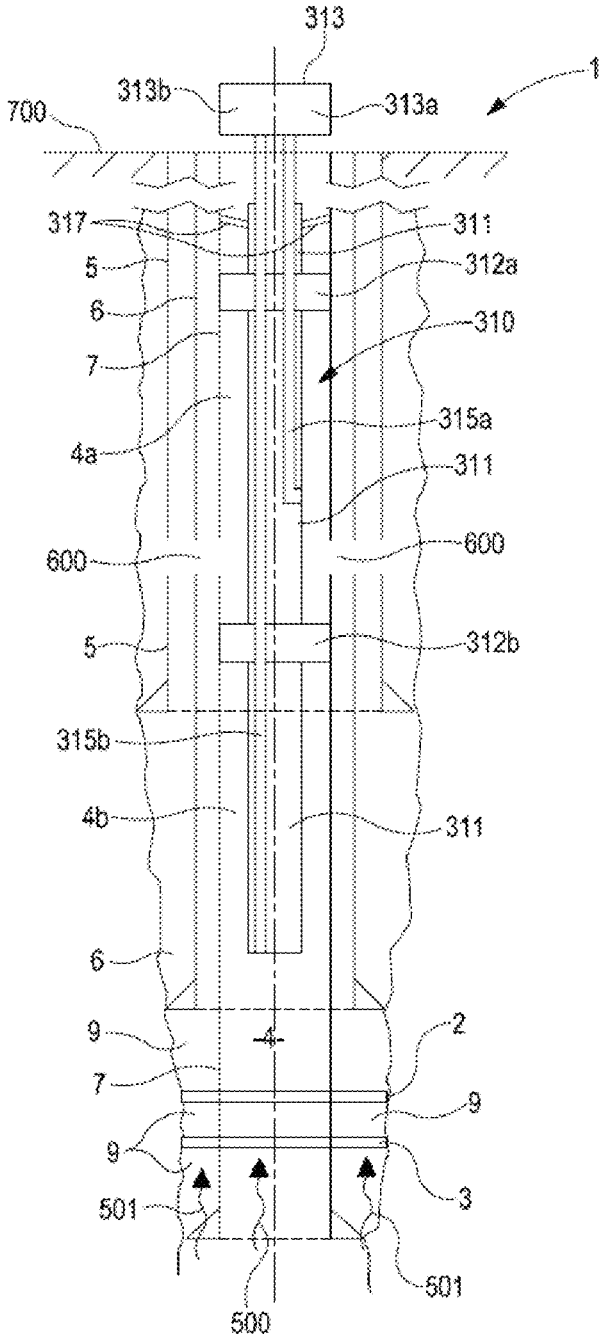
FIG. 8 is a schematic representation of apparatus for detecting a fluid which has leaked through a barrier in a wellbore, prior to the fluid leaking through, according to yet another embodiment.
Figure 9:
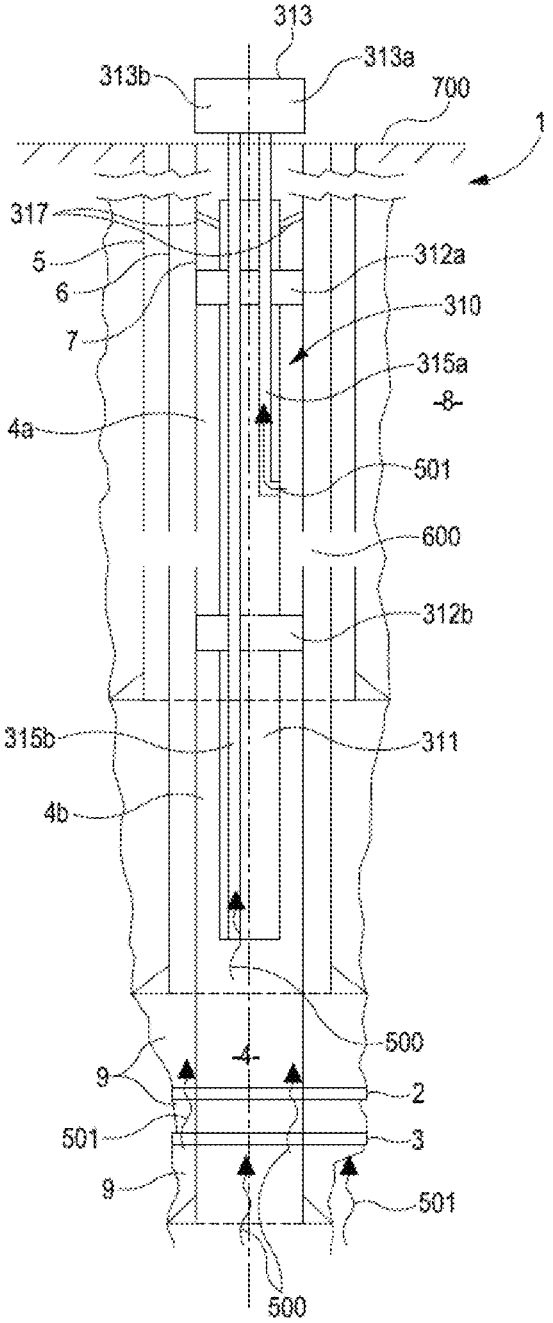
FIG. 9 is a schematic representation of the apparatus of FIG. 8 after fluid has leaked through the barrier.

In FIGS. 8 and 9, an apparatus 310 is arranged in the well 1. The apparatus 310 has first and second sealing devices 312*a*, 312*b* positioned on a mandrel 311 on either side of the perforations 600. The first sealing device 312*a* is arranged to contain fluid 501 in a region 4*a* of the wellbore 4 between the first and second sealing devices 312*a*, 312*b*. The second device 312*b* is arranged to contain fluid 500 in a second region 4*b* between the second sealing device 312*b* and the barrier 2. The second sealing device 312*b* in effect isolates the two regions 4*a*, 4*b* of the bore so that fluid migrating due to leakage in the barriers 2, 3 on the outside of the inner casing 7 can enter and accumulate in the first region 4*a* through the perforations 600 whilst hydrocarbon fluid migrating upward on the inside of the inner casing enters the second region 4*b*, so as to function in this respect in the same way as the above described apparatus 110 (see FIGS. 3 and 4) and the apparatus 210 (see FIGS. 5 and 6).

However in this embodiment, sensing apparatus 313 is provided at a surface 700 above the top of the well 1. The surface 700 may for example be a surface of a topsides platform or a surface of the Earth such as the ground, or the seabed in the case of a subsea well. The apparatus 310 also includes first and second pipes 315*a*, 315*b* in the mandrel 311, providing fluid communication between the respective first and second regions 4*a*, 4*b* and the sensing apparatus 313. The sensing apparatus 313 comprises sensors 313*a* for detecting properties of the fluid in the first region 4*a*, and sensors 313*b* for detecting properties of the fluid in the second region 4*b*. The sensors 313*a*, 313*b* may include any of fluid-type sensors, pressure and temperature sensors functioning for detecting the presence of the leaked fluids.

Barriers of similar sort to the barriers 2, 3 are used in wells in other industries, such as in wells which may be used to store radioactive waste or the like within the Earth's crust, and possibly also gas storage wells, $CO_2$ storing wells and geothermal wells.

Thus, although the above examples have been described with reference to petroleum wells where hydrocarbon fluids may leak through the barriers, the apparatus described may also be applied in other types of wells, such as for example wells which contain radioactive material, water and/or gas injection wells and possibly also gas storage wells, $CO_2$ storage wells or geothermal wells which are plugged with barriers, for short-term or long-term abandonment. In such wells, the apparatus may be equipped with suitable sensors for detecting the material in question. For example, in the case that the leaking material is radioactive, e.g. in wells subjected to radioactive material, sensors can be provided for detecting radioactivity of the fluid using the sensors. In this way, if radioactive material has leaked through the barriers, the radioactivity data from those sensors can be used to detect the material indicating that the barrier has leaked.

Although perforations in the wall of the casing are described above, it will be appreciated that openings or gaps of other forms can be provided through the wall of the casings for leaking fluid to pass through.

It can be noted that the various apparatus described above can function in variants where some fluid communication is allowed along the bore through the sealing devices. In other words, and as described in more detail below, the sealing devices of the invention do not necessarily need to fully seal the bore 4, although full sealing can be advantageous, for example to isolate regions along the bore for identifying leakage paths. Preferably however, some form of containment of fluid is sought by the sealing devices or other containing devices provided in their place. A benefit of such a device is that further plugging of the well 1 can be performed in the region above the apparatus, without removing it, using the containing device to provide a foundation. Thus, after the apparatus has been installed in the well, and a leak has been identified, barrier material such as cement can be injected into the bore 4 onto the sealing or containing device which helps to support the barrier material while it sets.

Yet further variants can include omitting such containing or sealing devices altogether. In such a variant, an arrangement such as that illustrated in FIG. 3 could be employed, without the sealing devices 112*a*, 112*b* where the mandrel 111 is simply anchored in position in the well, with the sensors 113*a*, 113*b* on either side of the perforations 600. The sensors 113*a* sense properties in the bore influenced by fluid leakage from the barriers 2, 3 on a path through the perforations 600 whilst the sensors 113*b* can sense properties in the bore without that influence. As such, differences in the response from sensors 113*a*, 113*b*, for example, may be used to distinguish between fluid leaked through the barriers 2, 3 on the inside and outside of the inner casing 7. Another variant of this concept is described below with reference to FIG. 10.

In other variants, one of which is described below with reference to FIGS. 10-13, the mandrel in the embodiments described above may have a bore or passageway which may be used for delivering remedial barrier material into the wellbore if a leakage is detected to a location below one or more of the containing or sealing devices. Normally the passageway may be closed when it is sought to contain the leaked fluid.

It should be appreciated that in the well 1 in FIGS. 1 to 9 would normally include a conductor pipe in accordance with conventional practice within well construction, where the casings 5, 6, 7 are installed within the conductor pipe. The conductor pipe extends into the subsurface 8, typically within the upper 50-100 m thereof.

In addition, whilst two barriers 2, 3 are illustrated in the FIGS. 1 to 9 that are spaced apart, this could in certain embodiments be replaced by a single barrier, or two barriers arranged in one composite barrier structure in which the barriers may not be separated.

In particular embodiments, the barriers 2, 3 may contain tracer material which may be triggered to release from the barrier into the regions 4*a*, 4*b* of the wellbore. Sensors may be provided to detect the tracer material in either or both of the regions 4*a*, 4*b* in order to detect that fluid has leaked from the barrier into those regions 4*a*, 4*b*.

Figure 10:
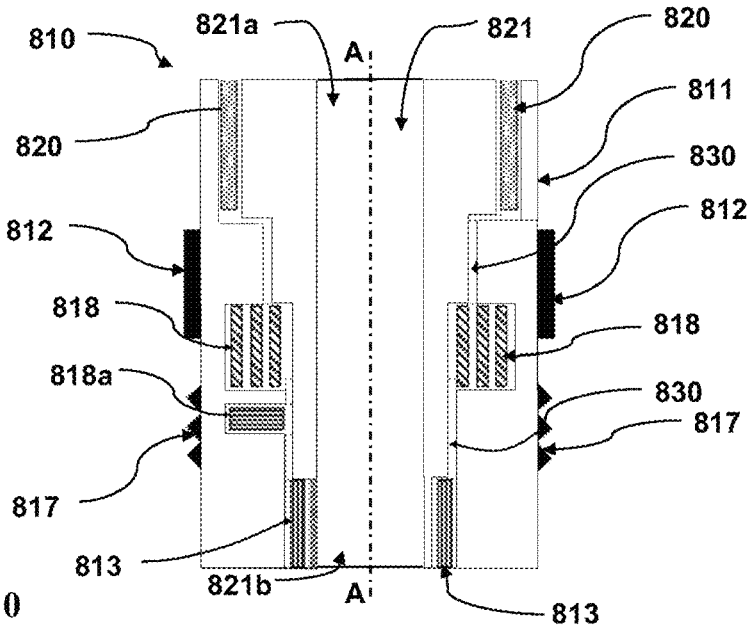
FIG. 10 is a schematic representation of another embodiment, illustrated as a side view and sectional drawing along the apparatus longitudinal axis, the apparatus having a through-going bore aligned with the longitudinal axis.

A further embodiment of the invented apparatus is illustrated in FIG. 10. The apparatus 810 comprises an elongate body in the form of a mandrel 811. It should be understood that the mandrel preferably has a circular cross-section. The apparatus body 811 comprises a bore 821, extending through the body, generally concentric with the body longitudinal axis A-A, and having an upper opening 821*a* and a lower opening 821*b*. The bore may be used for delivering remedial barrier material into the wellbore below the apparatus.

Sealing devices 812 are arranged on the body 811 and configured to move between a retracted (non-sealing) position and an extended position in which they seal against an adjacent casing wall, similarly to the sealing device 12 described above with reference to FIG. 1. Retractable and extendable anchors 817, for example in the form of slips, are arranged on the body 811 and configured to secure the apparatus in a casing, similarly to the anchors described above with reference to FIG. 1. Such sealing devices and anchors, including their operation, are well known in the art, and need therefore not be described in more detail here.

The body 811 also comprises power packs 818, for example in the form of batteries, which provide power to a control module 818*a*, acoustic transceivers 820 and sensors 813. Reference number 830 schematically indicate power cables and wires (for signals, etc.), connecting the components.

The control module 818*a* may be similar to the electronics package 18 described above with reference to FIG. 1, and comprises data processing means, data storage means and controllers for activating the sealing devices 812 and anchors 817.

The sensors 813 are arranged for measuring one or more properties of the fluid contained in a region in the vicinity of the apparatus, corresponding to the sensors 13 described above with reference to FIG. 1. FIG. 10 shows the sensors 813 arranged on the underside of the body 811; however, the sensors may also be arranged on the body periphery, similarly to the arrangement of the sensors 13 in FIG. 1. The sensors 813 correspond to the sensors 13, and may be configured to sense such fluid properties as pressure and temperature.

The acoustic transceivers 820 are configured to transmit data to a unit arranged above (i.e. in the uphole direction of) the apparatus 810, such as another apparatus in the wellbore or a receiver on the surface above the wellbore. The acoustic transceivers may be replaced by other suitable wireless communication means. For example, electromagnetic transceivers means may be used. Alternatively, data may be communicated to the surface above the wellbore by a data retrieval probe, as described above with reference to the embodiment illustrated in FIG. 1.

Figure 11:
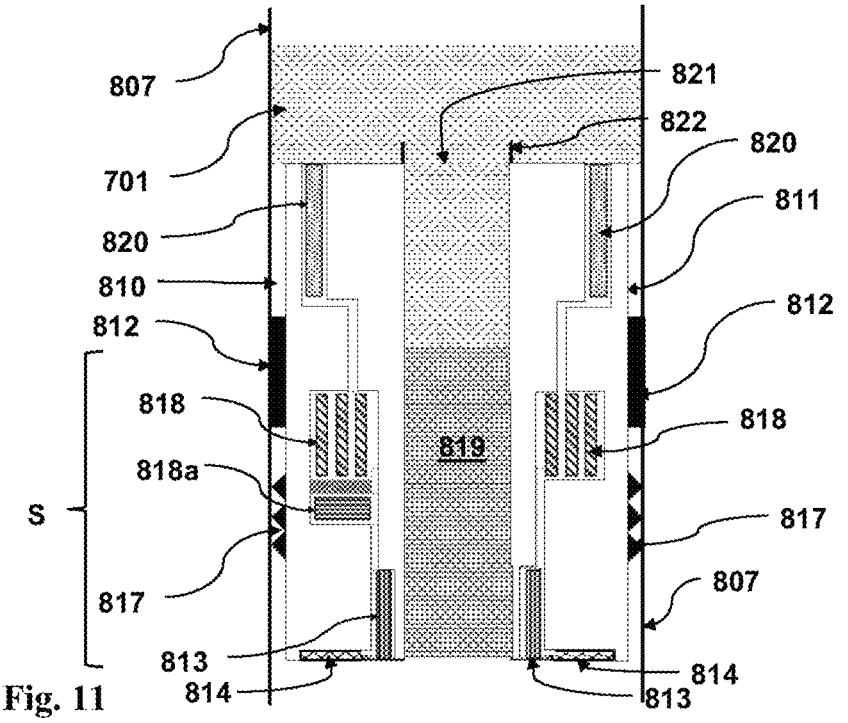
FIG. 11 is a schematic representation of the apparatus illustrated in FIG. 10, installed in a tubular and fitted with an optional centralizer device, and an axial portion of the through-going bore is filled with a sealing and drillable material, and a barrier (e.g. cement) is placed within the tubular and on top of the apparatus.

FIG. 11 illustrates the apparatus 810, installed in a wellbore inner casing 807 (corresponding to the inner casing 7 described above). The anchors 817 have been extended into gripping engagement with the casing wall, and the sealing devices 812 have been extended into sealing engagement with the casing wall. In this embodiment, an axial portion S of the through-going bore 821 is completely filled with a sealing and drillable material 819, whereby the apparatus may be used as a sealing plug. Examples of such sealing and drillable material include polymers, resins, bismuth or alloys of bismuth, but the invention shall not be limited to such materials. It should be understood that "drillable material" in this context means any material which may be removed by drilling, milling, or other controlled means and methods. Thus, the term "drillable material" may also encompass such sealing and removable material as glass or other frangible material which may be removed from the bore by means which are well known in the art.

In the configuration illustrated in FIG. 11, barrier cement 701 has been placed on top of the apparatus, and is filling an upper portion of the bore 821.

In the event that it becomes necessary to drill or mill through the material 819, a circular neck 822 which is connected to the upper part of the body 811 may be a useful centralizer device. The neck 822, which is optional and will be described in more detain below with reference to FIG. 14, extends a distance in the axial direction and is in effect a position indicator which facilitates re-entry.

The apparatus 810 illustrated in FIG. 11 also comprises one or more transceivers 814 (two shown in FIG. 11), connected to the power pack 818 and control module 818*a*. The transceivers are configured to communicate with transceivers on pieces of apparatus below (e.g. farther downhole) the apparatus 810, in a manner which per se is known in the art. The transceivers may comprise acoustic communication means, or other suitable wireless communication means. Therefore, it should be understood that acoustic transceivers 820 on a first apparatus may communicate with transceivers 813 on a second apparatus farther uphole than the first apparatus. In general, therefore, the (upper) transceivers 820 and the (lower) transceivers 814 may be similar types of devices.

Figure 12:
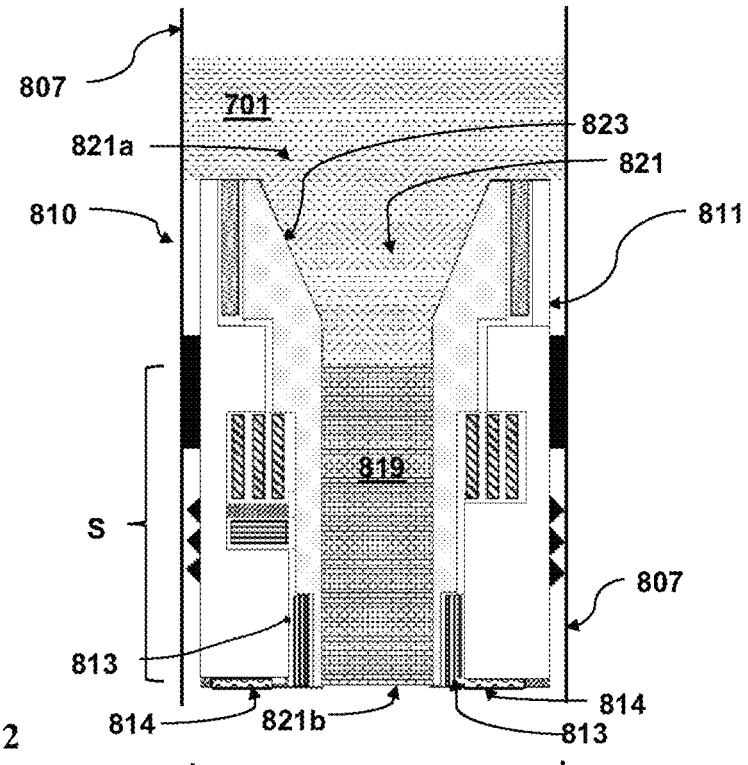
FIG. 12 is a schematic representation of the apparatus illustrated in FIG. 10, installed in a tubular and wherein an upper portion of the through-going bore has a funnel shape and a lower portion of the through-going bore is filled with a sealing and drillable material, and a barrier (e.g. cement) is placed within the tubular and on top of the apparatus.
Figure 13:
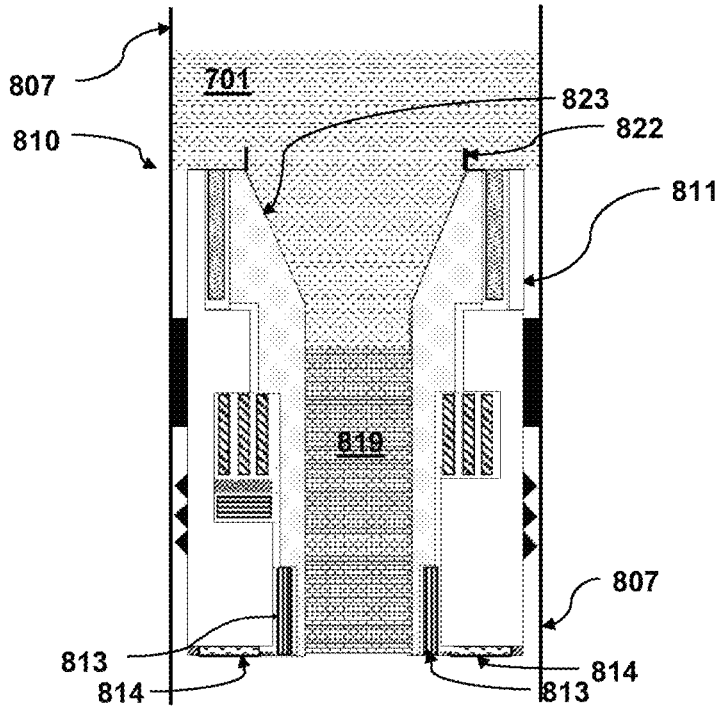
FIG. 13 is a schematic representation of the apparatus illustrated in FIG. 12, installed in a tubular and fitted with an optional centralizer device.

FIG. 12 illustrates a further embodiment of the apparatus, in which an upper portion 823 of the bore 821 has a funnel shape, in order to further facilitate re-entry. The funnel-shaped portion 823 serves to guide a drill bit that might be off centre, into the bore 821, whereby the material 819 may be drilled out. FIG. 13 shows an apparatus similar to that of FIG. 12, but with the (optional) circular neck 822.

Figure 14:
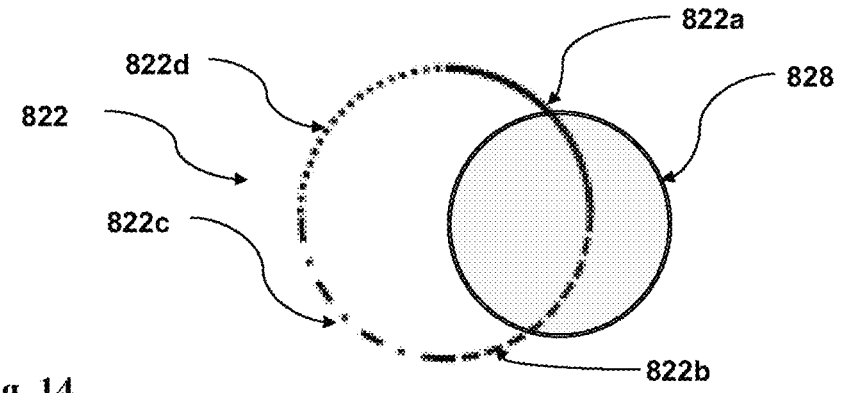
FIG. 14 is a schematic representation, in a plan view, of the centralizer device.

FIG. 14 is an illustration of the circular neck 822. The neck is made of a drillable or millable material, for example a plastic material or a ceramic material, and has a suitable height (e.g. 40-60 cm). The neck comprises a plurality (four shown in FIG. 14) of sectors 822*a-d* having different properties, for example different colours. If the drill bit 828 is off-center with respect to the through-going bore, it will drill into the neck 822 and produce fragments that may be analysed uphole. For example, in the situation illustrated in FIG. 14, the drill bit 828 will produce fragments from sectors 822*a* and 822*b*, and thus provide feedback information to the operator as to the misalignment of the drill bit. Based on this information, the operator may reposition the drill bit accordingly in order to centralize it with respect to the through-going bore 812. The neck 822 is thus in effect a centralizer device.

Figure 15:
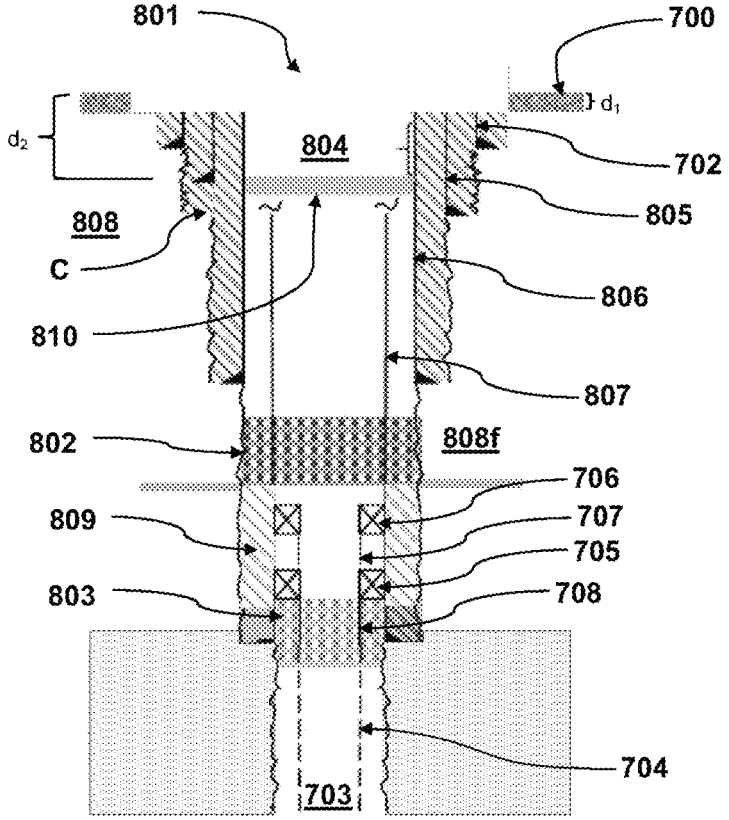
FIG. 15 is a schematic representation of a well in which the invented apparatus is installed.

FIG. 15 is a schematic representation of a well 801 in which the invented apparatus 810 is installed. A wellbore 804 extends from an uphole surface 700 into a reservoir 703. The surface 700 may be a subsea seabed or a ground surface on dry land.

A conductor pipe 702 extends from a level $d_1$ (typically 5 meters) below the surface 700 into the subsurface 808, and casings are installed within the conductor pipe. In the example of FIG. 15, the wellbore 804 is cased by outer casing 805, intermediate casing 806, and inner casing 807. The wellbore 804 extends into the subsurface 8, and can be accessed in the space within the innermost casing 807, allowing the apparatus 810 to be deployed and installed within the wellbore 804. Each of the casings 805, 806, 807 is tubular in shape and typically has several sections placed end to end in succession along the bore 804. The inner casing 807 may be a standard 9⅝" casing.

The intermediate casing 806 is arranged concentrically within the outer casing 805 and the inner casing 807 is in turn arranged concentrically within the intermediate casing 806. Securing material such as cement C or the like, is present around the outside of the respective casings 805, 806, 807 having been used, as is typically the case, to secure the casings in place during construction of the well 801 and to prevent flow in the different annuli. In this way, a structure of alternating layers of the casings 805, 806, 807 and securing material provides a wall for the wellbore 804.

Barriers 802, 803 are installed in the well and configured for plugging the wellbore 804 inside the inner casing 807 and for plugging an annular region 809 between the inner casing 807 and a geological formation 808*f* of the subsurface 808.

In FIG. 15, the apparatus 810 is installed a distance $d_2$ (for example 55 meters) below the surface 700. The volume between the apparatus 810 and the surface 700 may be filled with barrier cement (e.g. as shown as reference number 701 in FIGS. 11, 12, 13 above).

A completion tubing 707 is connected to the inner casing via a completion packer 706. A production liner 708 comprises a production screen 704 extending into the reservoir 703, and is connected to the completion tubing via a liner hanger 705.

Figure 16:
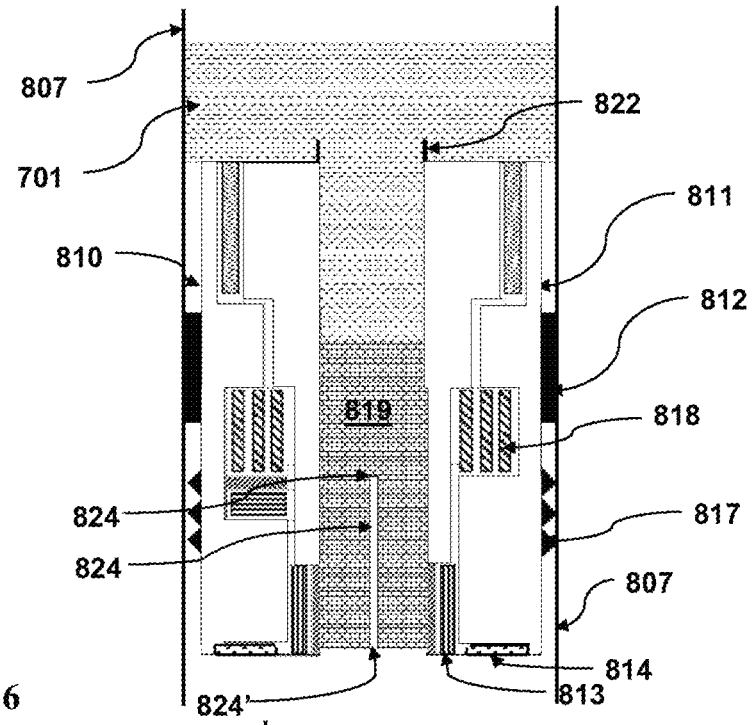
FIG. 16 is a schematic representation of the apparatus as illustrated in FIGS. 10 and 11, in which a capillary tube is partly embedded in the sealing and drillable material.

Another embodiment of the apparatus 810 is illustrated in FIG. 16. Here, a capillary bore 824 (hereinafter referred to as a tube) extends a portion inside the sealing and drillable material 819. The tube 825 has an opening 824' facing the volume below the apparatus and is thus exposed to the fluid pressure inside that volume. The other (upper) end 824" of the tube is closed, inside the sealing and drillable material 819. In a re-entry situation, in which the sealing and drillable material 819 is being drilled or milled out from above the apparatus, the tube upper end 824" will be opened when the drill bit reaches the tube upper end, and thus provide fluid communication between the volume below the apparatus and the volume above the apparatus. Due to the small size (capillary) of the tube, however, any significant mass flow through the tube is prevented, but the opened tube provides a means for measuring the pressure below the apparatus, and the sensor for measuring this pressure may be placed at a location above the apparatus (e.g. on another apparatus further uphole). The capillary tube is dimensioned according to the dimension of the apparatus and the cross-section of the through-going bore 821, as the skilled person will understand. In general, the capillary tube cross-section is very small, compared to the through-going bore cross-section. The drawing in FIG. 16 is not to scale.

The tube 824 is thus in effect a safety device, in that it provides information about the pressure below the apparatus before the sealing and drillable material 819 is removed and the bore 821 is completely opened. In this manner, excess and dangerous pressure below the apparat may be detected while the apparatus is still sealed. It should be understood that the capillary tube 824 may also be embedded in the sealing and drillable material 819 in the embodiment of the apparatus illustrated in FIGS. 12 and 13.

Figure 19:
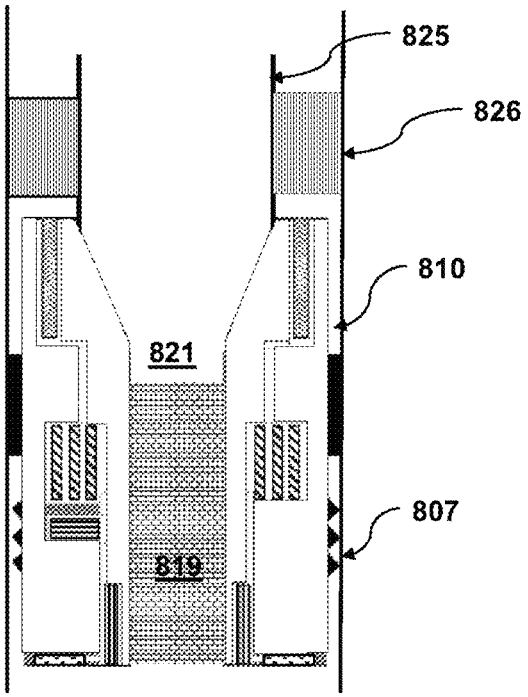
FIG. 19 is a schematic representation of an embodiment of the apparatus, installed in a tubular and connected to a tieback liner.
Figure 20:
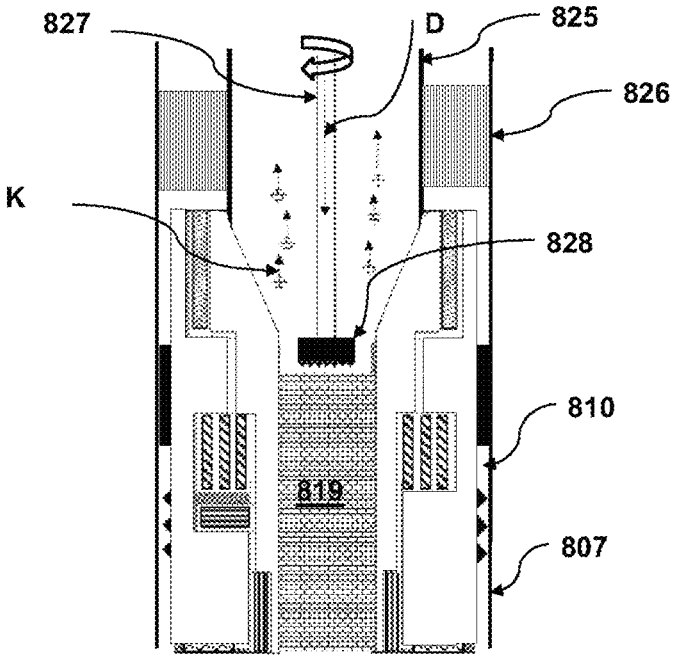
FIG. 20 corresponds to FIG. 19, and illustrates a drill bit and drill string arranged inside the tieback liner and drilling though the sealing and drillable material.

With the invented apparatus, it is possible to perform a tieback operation, and connect to the plug (i.e. apparatus) itself with a tieback liner-and-connection assembly from a drilling platform or vessel/rig, for pressure control. This is illustrated in FIG. 19, where a tieback liner 825 has been connected to the apparatus 810 (in a manner which is well known in the art) and liner seal elements 826 have been set against the casing wall 807. In this configuration, it is possible to mill through the sealing and drillable material 819 using e.g. coiled tubing or drillpipe. This is illustrated in FIG. 20, where a coiled tubing or a drillstring 827 is deployed through the tieback liner 825 to drill through the drillable material 819 in the apparatus 810. Drillfluid (indicated as "D" in FIG. 20) of a specific gravity to obtain pressure control when drilling through the drillable material is deployed through the coiled tubing string or drillstring 827, and pumped with such a velocity that drill or mill cuttings (indicated as "K" in FIG. 20) is returned to the surface with the drilling fluid in the annulus between the outer surface of the coiled tubing string or drillstring 827 and the casing 807. A light BOP may be connected on the tieback liner if necessary.

Figure 17:
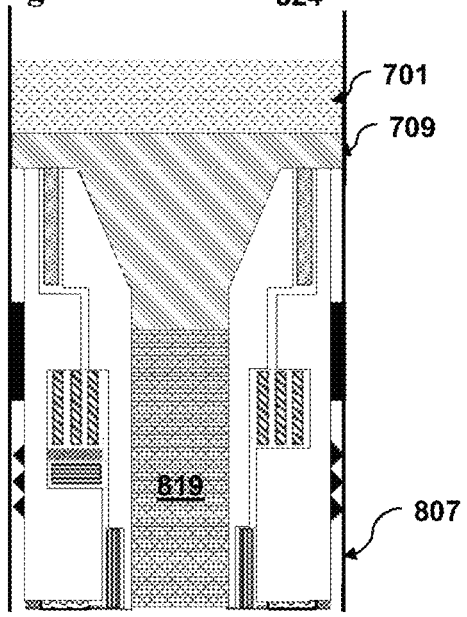
FIG. 17 is a schematic representation of an embodiment of the apparatus installed in a tubular, with a granular substance (e.g. sand or gravel) arranged above the sealing and drillable material in the through-going bore, and a layer of barrier cement.
Figure 18:
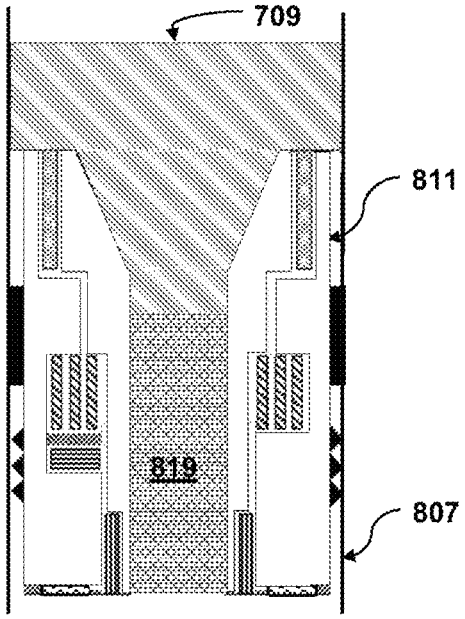
FIG. 18 corresponds to FIG. 17, but the layer of barrier cement has been removed and the layer of granular substance is thicker than in FIG. 17.

In order to facilitate the perform the tieback operation, and referring to FIG. 17, sand or gravel 709 may is placed on and above the apparatus, with cement 701 (or similar) above, in order to obtain a clean surface on the apparatus by washing out the sand after milling through the cement. After washout, the tieback liner may be connected to the apparatus. In FIG. 18, only sand (or gravel) 709—not cement—is placed above the apparatus. This configuration is relevant when the apparatus is used as a surface barrier, in which case the sand or gravel 709 extends all the way up to the surface/seabed 700. Re-entering the well through the apparatus may then be performed by washing out the sand or gravel before connecting the tieback liner to the apparatus. Milling or drillout of cement is thus not necessary before re-entering the well with a workstring.

Figure 21:
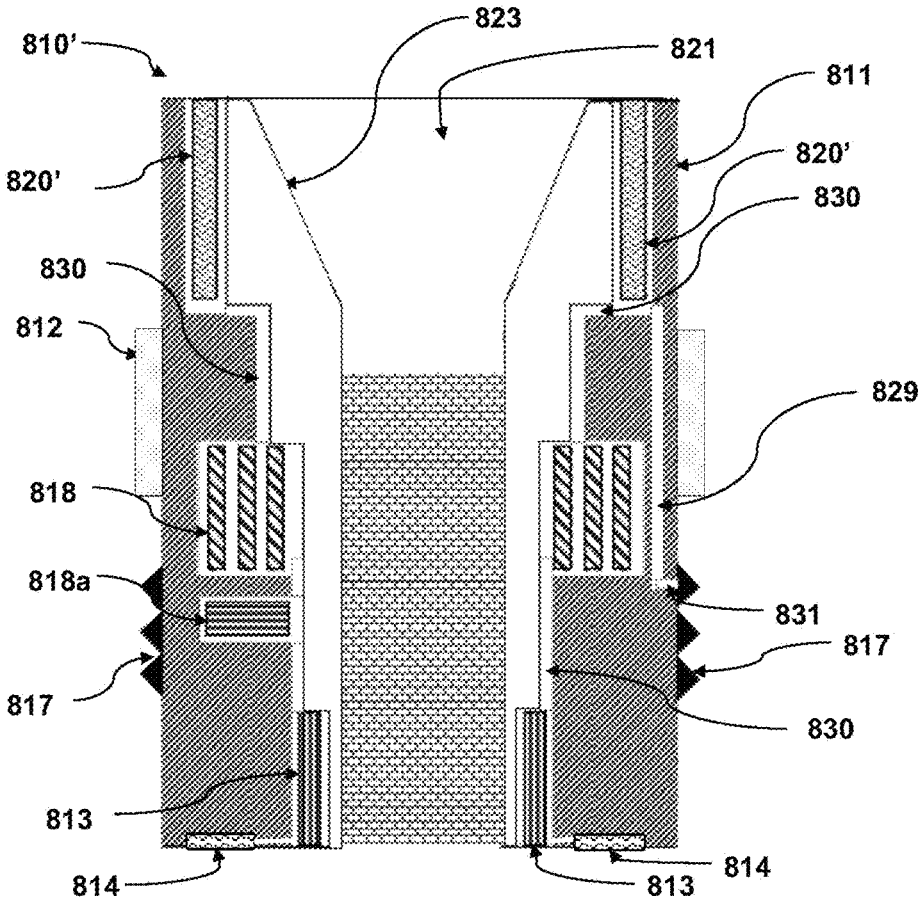
FIG. 21 is a schematic representation of an embodiment of the apparatus, having transceiver means.

Referring now to FIG. 21, an alternative embodiment of the apparatus 810' comprises electromagnetic transceivers 820', as an alternative or supplement to the acoustic transceivers 820 described above. A cable 829 extends between the electromagnetic transceiver and an electrical contact 831 on, or connected to, the anchor 817, thereby providing electrical contact between the apparatus and the tubular (i.e. casing) wall and thus generating a dipole. It should be understood that other suitable downhole wireless communication means may be used.

Figure 22:
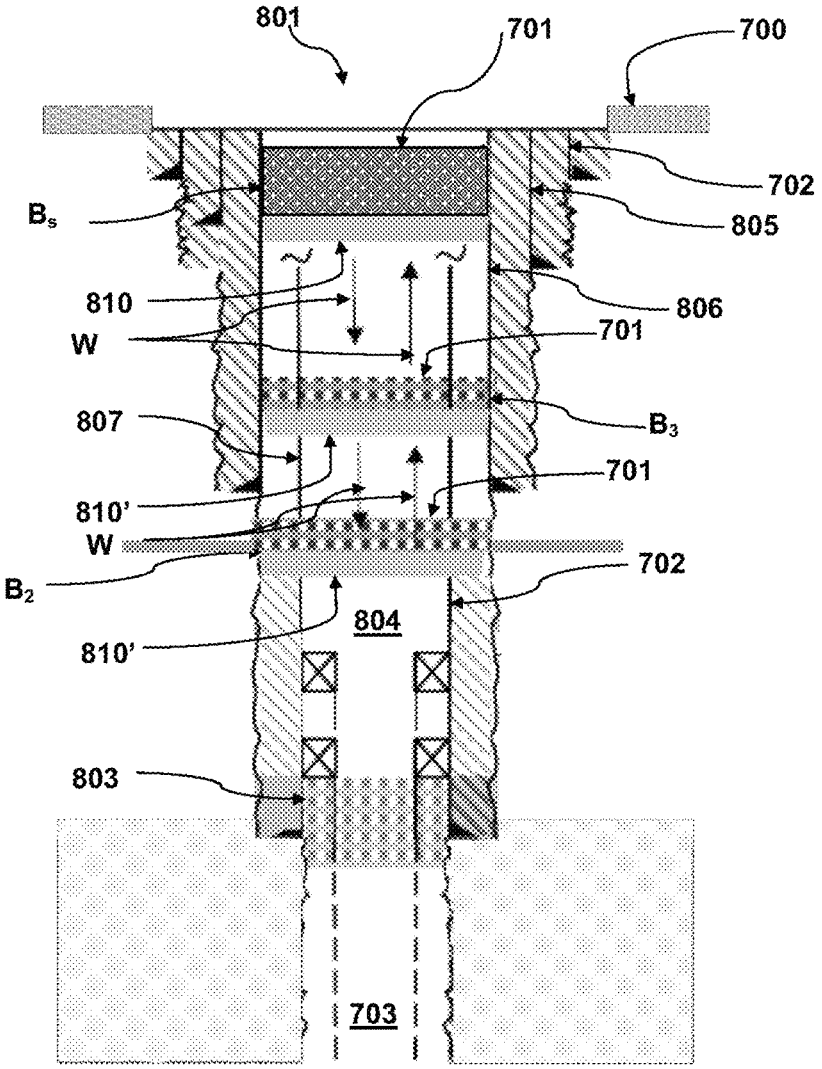
FIG. 22 is a schematic representation of a well in which three of the apparatuses are installed.

FIG. 22 is a schematic representation of a well 801, corresponding to the well described above with reference to FIG. 15. In FIG. 22, however, three of the invented apparatus are installed, forming three barriers. The lower barrier 803 forms a primary well barrier. An apparatus 810' (described above with reference to FIG. 21) and barrier cement 701, form a secondary barrier $B_2$; and another apparatus 810' and barrier cement 701 form a tertiary barrier $B_3$. An apparatus 810 (e.g. as described above with reference to FIGS. 10-13) and barrier cement 701 form a surface barrier $B_s$. It should be understood that in the context of this description, "cement" shall mean any suitable barrier material which fulfils the applicable regulatory requirement with regard to pressure control and leakage prevention. The upper and lower transceivers 814, 820, 820' facilitate signal communication (indicated by arrows W) between the barriers (i.e. apparatus 820; 820'). It should be understood that more or fewer barriers may be installed in the well; FIG. 22 merely illustrates an example.

Each apparatus 810; 810' forming the individual barriers $B_2$ $B_3$, $B_s$, may emit unique identification signals, in a manner which is well known in the art, whereby the originator apparatus always may be identified. For example, if the transceivers in the apparatus in the tertiary barrier $B_3$ should malfunction, the signals W from the secondary barrier $B_2$ will be detected (albeit attenuated) by the transceivers in the surface barrier $B_s$ apparatus, and the correct originator will be identified.

Using the invented apparatus in this manner effectively provides a repeater functionality, in which signals (e.g. data) from a lower apparatus may be transmitted to an apparatus higher up in the well (and to the surface), and vice versa. This repeater functionality makes it possible to apply the apparatus as a foundation for deeper barriers in the well, and at the same time allow for two-way communication between the plugs. This makes it possible to obtain an early warning in the case of integrity failure in deeper well barrier elements, and will make it possible to prepare for re-entry and remedial work to restore integrity. The communication solution will advantageously incorporate a method for frequency sweep to iterate to the optimal frequency used for intercommunication between barriers.

Barriers similar to the barriers described above are used in wells in other industries, such as in wells which may be used to store radioactive waste or the like within the Earth's crust, and possibly also gas storage wells, $CO_2$ storing wells and geothermal wells. Thus, although the above examples have been described with reference to petroleum wells where hydrocarbon fluids may leak through the barriers, the apparatus described may also be applied in other types of wells, such as for example wells which contain radioactive material, water and/or gas injection wells and possibly also gas storage wells, $CO_2$ storage wells or geothermal wells which are plugged with barriers, for short-term or long-term abandonment. In such wells, the apparatus may be equipped with suitable sensors for detecting the material in question. For example, in the case that the leaking material is radioactive, e.g. in wells subjected to radioactive material, sensors can be provided for detecting radioactivity of the fluid using the sensors. In this way, if radioactive material has leaked through the barriers, the radioactivity data from those sensors can be used to detect the material indicating that the barrier has leaked.

Although the barriers 2, 3; 802, 803 are illustrated as deep set barriers as may be typical for abandonment after performing a plug and abandonment operation, it can also be noted that the apparatus described above may be used during the plug and abandonment operation itself. In such a case, the apparatus described above may be installed in the wellbore, and a surface plug or an environmental barrier may be installed using the apparatus as a foundation, e.g. by inserting cement or other plugging material into the wellbore which may then set in place. The apparatus is initially used to monitor the well and when determined that it is properly sealed, e.g. by no changes detected in the sensors, the surface or environmental plug may be set. The surface plug or environmental barrier may then be supported by the upper containing device of the apparatus.

The barriers may also include sensors for detecting properties of fluids below the barrier, e.g. for monitoring conditions in the wellbore or formations deep within the subsurface.

Various modifications and improvements may be made without departing from the scope of the invention herein described.

The invention claimed is:

1. An apparatus for monitoring at least a portion of a wellbore that includes a substance and a tubular located in the wellbore, the apparatus comprising a body comprising an anchoring means for releasably positioning the apparatus with respect to the tubular in the wellbore, a detecting means for detecting at least one parameter of the substance, and a transceiver means configured to transmit data related to the parameter, wherein the body comprises a mandrel comprising an axially extending, through-going, internal bore having respective first and second openings, a releasable sealing means, and wherein the anchoring means and the releasable sealing means are arranged on the body between the openings and configured to abut against a portion of an internal wall of the tubular.

2. Apparatus of claim 1, wherein at least an axial portion of the bore is filled with a sealing and removable material, whereby the apparatus is a plugging device.

3. Apparatus of claim 1, wherein the transceiver means comprises a wireless transmitter and receiver.

4. Apparatus of claim 1, wherein the detecting means comprises a sensor.

5. Apparatus of claim 1, wherein a sealing and removable material is extending axially through the body.

6. Apparatus of claim 5, wherein the sealing and removable material comprises a capillary tube extending an axial distance inside the sealing and removable material, and having a first, open, end in the vicinity of the through-going bore second opening, and a second, closed end inside the sealing and removable material.

7. Apparatus of claim 1, wherein drilling alignment means are arranged in or near the first opening.

8. Apparatus of claim 7, wherein the drilling alignment means comprises one or both of a circular element arranged around the first opening or a funnel-shaped profile in an upper portion of the bore.

9. A wellbore comprising a wellbore barrier comprising an apparatus according to claim 5.

10. Wellbore of claim 9, comprising a plurality of barriers and a plurality of apparatuses, wherein an apparatus in one barrier is configured to communicate with an apparatus in another barrier via the transceiver means.

11. A method of transmitting signals in a wellbore by means of a plurality of apparatuses as defined by claim 1, further comprising emitting a unique identification signal from a first apparatus; and receiving the unique identification signal at a second apparatus arranged farther uphole than the first apparatus.

12. The method of claim 11, further comprising transmitting the signal via a third apparatus arranged intermediate the first and second apparatuses.

13. The method of claim 11, further comprising transmitting the signal past a third, non-functioning apparatus.

14. The method of claim 11, further comprising emitting a data signal related to a parameter sensed by the detecting means by the first apparatus and receiving the data signal by the second apparatus.

* * * * *